US006102026A

United States Patent [19]

Fladgard et al.

[11] Patent Number: 6,102,026

[45] Date of Patent: Aug. 15, 2000

[54] FIBER-CEMENT CUTTING TOOLS AND METHODS FOR CUTTING FIBER-CEMENT MATERIALS, SUCH AS SIDING

[75] Inventors: Scott Fladgard; Lloyd Fladgard, both of Kingston; Joe Gaidjiergis, Renton, all of Wash.

[73] Assignee: Pacific International Tool & Shear, Ltd., Kingston, Mass.

[21] Appl. No.: 09/224,565

[22] Filed: Dec. 30, 1998

[51] Int. Cl.[7] ..... B28D 1/32

[52] U.S. Cl. ..... 125/23.01; 125/16.01

[58] Field of Search ..... 125/23.01, 16.01, 125/16.03, 40; 225/103, 104, 97; 83/624, 626, 679, 696, 468, 468.7

[56] References Cited

U.S. PATENT DOCUMENTS

| | | | |
|---|---|---|---|
| 2,874,688 | 2/1959 | Biesanz, Sr. et al. | 125/23 |
| 3,297,015 | 1/1967 | Crawford | 125/23 |
| 3,886,927 | 6/1975 | Chattin | 125/23 C |
| 5,570,678 | 11/1996 | Waggoner et al. | 125/23.01 |
| 5,662,094 | 9/1997 | Giacomelli | 125/23.01 |
| 5,722,386 | 3/1998 | Fladgard et al. | 125/23.01 |

*Primary Examiner*—Timothy V. Eley
*Assistant Examiner*—Dung Van Nguyen
*Attorney, Agent, or Firm*—Perkins Coie LLP

[57] ABSTRACT

Devices and methods for cutting fiber-cement materials, such as planks, panels, boards, backing substrates and other materials. A fiber-cement siding cutting tool in accordance with one embodiment of the invention can have an actuator including a driver that moves along a stroke path between a release position and a cutting position. The fiber-cement siding cutting tool can also have a pair of cutting blades including a first cutting blade having a first cutting edge and a second cutting blade having a second edge. The first cutting blade is coupled to the driver to move along the stroke path between the release position and the cutting position. The second cutting blade can be positioned along the stroke path such that the first cutting edge faces the second cutting edge. The fiber-cement siding cutting machine can also include a workpiece support assembly having a first support member on a first side of the stroke path and a second support member on a second side of the stroke path. The first and second support members are spaced apart from one another by a support distance, and the first and second support members each have a support region to support a fiber-cement siding workpiece in a support plane that is spaced apart from the second cutting edge toward the first cutting edge in the direction of the stroke path. The support regions, for example, can be spaced apart from the second cutting edge toward the first cutting edge in the direction of the stroke path by a bending distance to space a tensile side of the workpiece apart from the second cutting edge when the driver is in the release position.

14 Claims, 6 Drawing Sheets

FIBER-CEMENT CUTTING TOOLS AND METHODS FOR CUTTING FIBER-CEMENT MATERIALS, SUCH AS SIDING

TECHNICAL FIELD

The present invention generally relates to cutting tools and methods for cutting materials used on or in houses and other structures. More particularly, the invention is directed toward fiber-cement cutting tools and methods for cutting fiber-cement composite materials.

BACKGROUND OF THE INVENTION

The exterior surfaces of houses and other structures are often protected by exterior siding products made from wood, vinyl, aluminum, bricks, stucco, fiber-cement and other materials. Wood and fiber-cement siding (FCS) products, for example, are generally planks, panels or shakes that are "hung" on plywood or composite walls. Although wood siding products are popular, wood siding can become unsightly or even defective because it may rot, warp or crack. Wood siding products are also highly flammable and subject to insect damage. Therefore, wood siding products have several drawbacks.

FCS products offer several advantages compared to other types of siding materials. FCS is generally a composite material composed of cement, silica sand, cellulose and binders. To form FCS panels and planks, a liquid fibercement composite is rolled or pressed into the shape of the planks or panels, and then the fiber-cement composite is cured. FCS is advantageous because it is nonflammable, weatherproof, and relatively inexpensive to manufacture. moreover, FCS does not rot and insects do not consume the fiber-cement composites.

FCS products are typically installed by a siding contractor at a particular job site or a modular home manufacturer in a factory. To install FCS planks, for example, the planks are cut to a desired length and then nailed to plywood or wood-composite panels in a manner similar to hanging planks of cedar siding. After the FCS is installed, trim materials are generally attached to the structure. The FCS and the trim materials are subsequently painted.

FCS is often cut using an abrasive disk in a manner similar to cutting wood products with a hand-held power saw or a table saw. Cutting FCS with an abrasive disk, however, generates a very fine dust that creates an unpleasant working environment. The fiber-cement composite materials are also highly abrasive, and thus the abrasive-disks may wear out quickly. Thus, there are many disadvantages to cutting FCS with an abrasive disk.

FCS may also be cut with shears having opposing blades or hand-held cutting tools having a reciprocating cutting blade. Pacific International Tool & Shear, Ltd. has developed several shears and hand-held cutting tools, including those set forth in U.S. Pat. Nos. 5,570,678 and 5,722,386 (the "Pacific Patents"), and U.S. patent application Ser. No. 09/036,249, all of which are herein incorporated by reference. Several embodiments of the shears disclosed in the Pacific Patents have an actuator, an upper blade assembly coupled to the actuator to move along a cuffing path, and a lower blade assembly positioned under the upper blade assembly. The upper blade assembly has an upper blade, and the lower blade assembly has a lower blade. The shears disclosed in the Pacific Patents can also have first and second support members on either side of the lower blade, and the first and second support members can have first and second support surfaces in a common workpiece support plane. The lower blade in the Pacific Patents is configured such that its cutting edge is either at the support plane or projects slightly above the support plane toward the upper blade. In operation, a workpiece slides across the lower blade until a desired cutting plane is aligned with the upper and lower blades. The actuator then drives the upper blade against an upper surface of the FCS workpiece to penetrate the upper and lower blades into opposite sides of the workpiece. The upper and lower blades generate a crack that propagates along the cutting plane through the workpiece to cut the workpiece along the cutting plane.

Although the shears disclosed in Pacific Patents cut a clean edge in FCS without producing dust, one operating concern of these shears is that it can be difficult to cut long sections of an FCS workpiece in a single stroke of the blades. For example, to cross-cut a 4'×8' panel of ¼-inch thick FCS, Pacific International Tool and Shear developed a shear similar to those described in U.S. Pat. No. 5,570,678 that required three pneumatic cylinders operating at a pressure of 150 psi. The same shear, however could not cross-cut a 4'×8' panel of 5/16-inch thick FCS operating at a pressure of 150 psi in each pneumatic cylinder. One solution to this problem is to use more force to drive the upper and lower blades into the FCS workpiece, but this solution requires larger and/or more actuators that significantly increases the cost and the number of moving components that can malfunction.

Another operating concern of the cutting tools disclosed in the Pacific Patents is that the upper and lower blades may wear relatively quickly. FCS quickly grinds or otherwise abrades most metals because it is highly abrasive. As a result, any contact with FCS dulls the cutting edges of the upper and lower cutting blades. The lower blades of the shears disclosed in the Pacific Patents are particularly susceptible to wear because the FCS workpiece typically slides across the edge of the lower blade to position a cutting line on the workpiece between the upper and lower blades. Thus, even though the shears disclosed in the Pacific Patents work well in many applications, there is a need to efficiently cut long sections of FCS and reduce wear of the cutting blades.

SUMMARY OF THE INVENTION

The present invention is directed toward devices and methods for cutting fiber-cement materials, such as siding or other materials. A fiber-cement siding cutting tool in accordance with one embodiment of the invention includes an actuator having a driver that moves along a stroke path between a release position and a cutting position. The fiber-cement siding cutting tool can also have a pair of cutting blades including a first cutting blade having a first cutting edge and a second cutting blade having a second edge. The first cutting blade is coupled to the driver to move along the stroke path between the release position and the cutting position. The second cutting blade can be positioned along the stroke path such that the first cutting edge faces the second cutting edge. The first cutting blade, for example, can be superimposed over the second cutting blade.

The fiber-cement siding cutting machine can also include a workpiece support assembly having a first support member on a first side of the stroke path and a second support member on a second side of the stroke path. The first and second support members are spaced apart from one another by a support distance, and each of the first and second support members has a support region to support a fiber-cement siding workpiece in a support plane. The support regions, for example, can be spaced apart from the second cutting edge toward the first cutting edge in the direction of the stroke path by a bending distance such that the support plane is spaced apart from the second cutting edge by the bending distance. The support members accordingly space a tensile side of the workpiece apart from the second cutting edge by the bending distance.

The first and second support members can have several different embodiments that position the tensile side of the workpiece away from the second cutting edge. In one embodiment, for example, the first and second support members are first and second elongated rollers that rotate about first and second rotational axes, respectively. The first and second elongated rollers can extend at least substantially parallel to a lengthwise dimension of the second cutting blade such that the support regions are defined by the uppermost points of the first and second rollers. The first and second support members can alternatively be first and second wheels or elongated bars that are spaced apart from the second cutting edge by the bending distance.

In one embodiment of a method for operating the FCS cutting tool, the actuator initially holds the driver in the release position as an FCS workpiece moves over the first and second support members until a cutting plane in the workpiece is aligned with the stroke path. The FCS workpiece accordingly has a first side facing the first blade and a second side facing the second blade. Because the first and second support members space the FCS workpiece apart from the second cutting edge when the driver is in the release position, the second cutting blade does not engage the second side of the FCS workpiece at this point of the method. The actuator then moves the driver along the stroke path to drive the first cutting edge against the first side of the FCS workpiece. The first cutting blade accordingly exerts a force that bends the FCS workpiece between the support members to impart compressive stress to the first side of the FCS workpiece and tensile stress to the second side of the FCS workpiece. As the driver continues to move along the stroke path, the FCS workpieces continue to bend until the second side of the workpiece engages the second cutting edge. The first and second edges then penetrate into the first and second sides of the workpiece to generate a crack that propagates along the cutting plane through the workpiece.

DETAILED DESCRIPTION OF THE INVENTION

The present invention is generally directed toward cutting tools and methods for cutting fiber-cement materials, such as panels, planks, shakes, backing pieces and/or boards. Many specific details of certain embodiments of the invention are set forth in the following description, and in FIGS. 1–5, to provide a thorough understanding of such embodiments. One skilled in the art, however, will understand that the present invention may have additional embodiments, or that the invention may be practiced without several of the details described in the following description.

Figure 1:
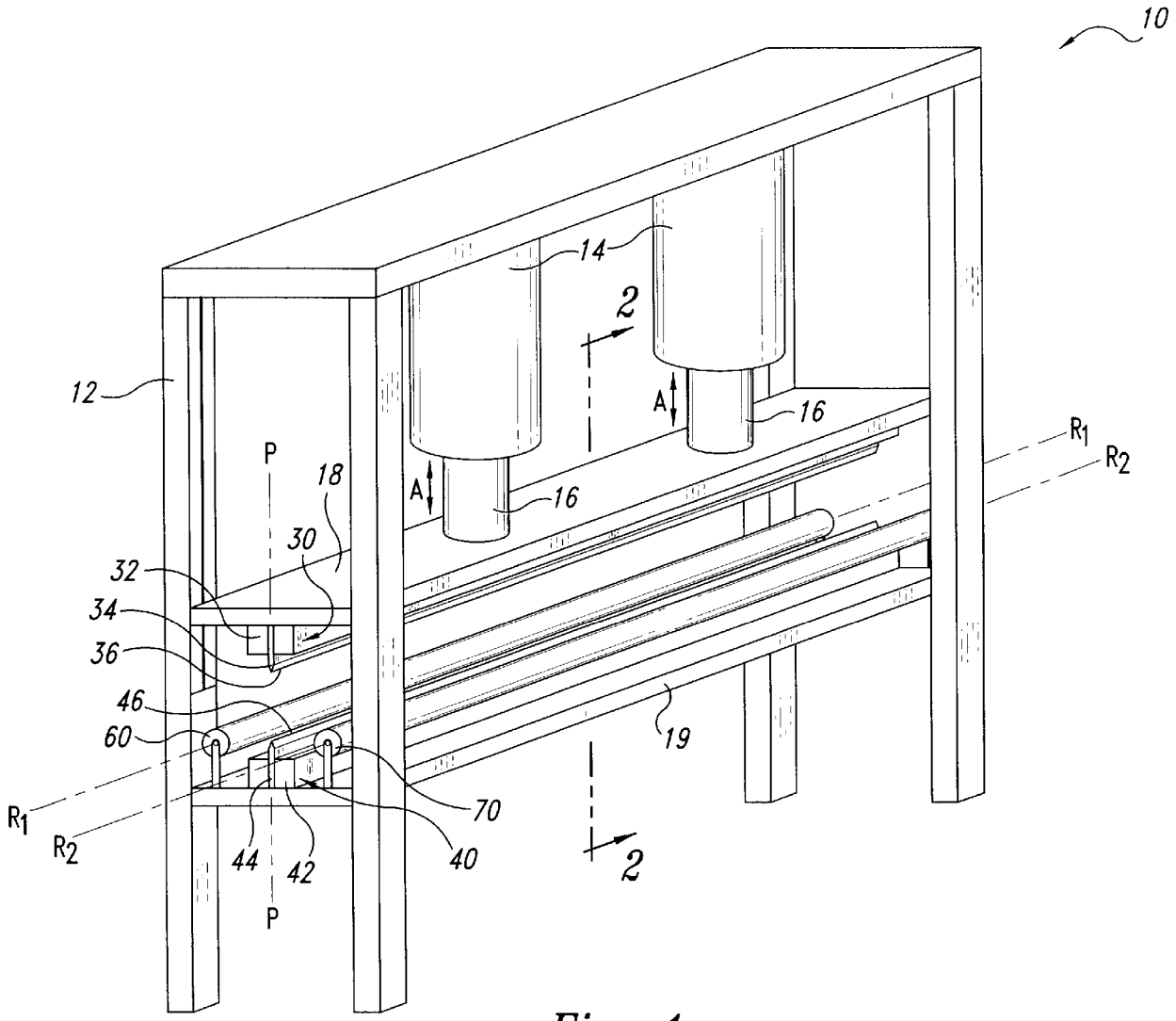
FIG. 1 is an isometric view of a fiber-cement siding cutting tool in accordance with one embodiment of the invention.
Figure 2:
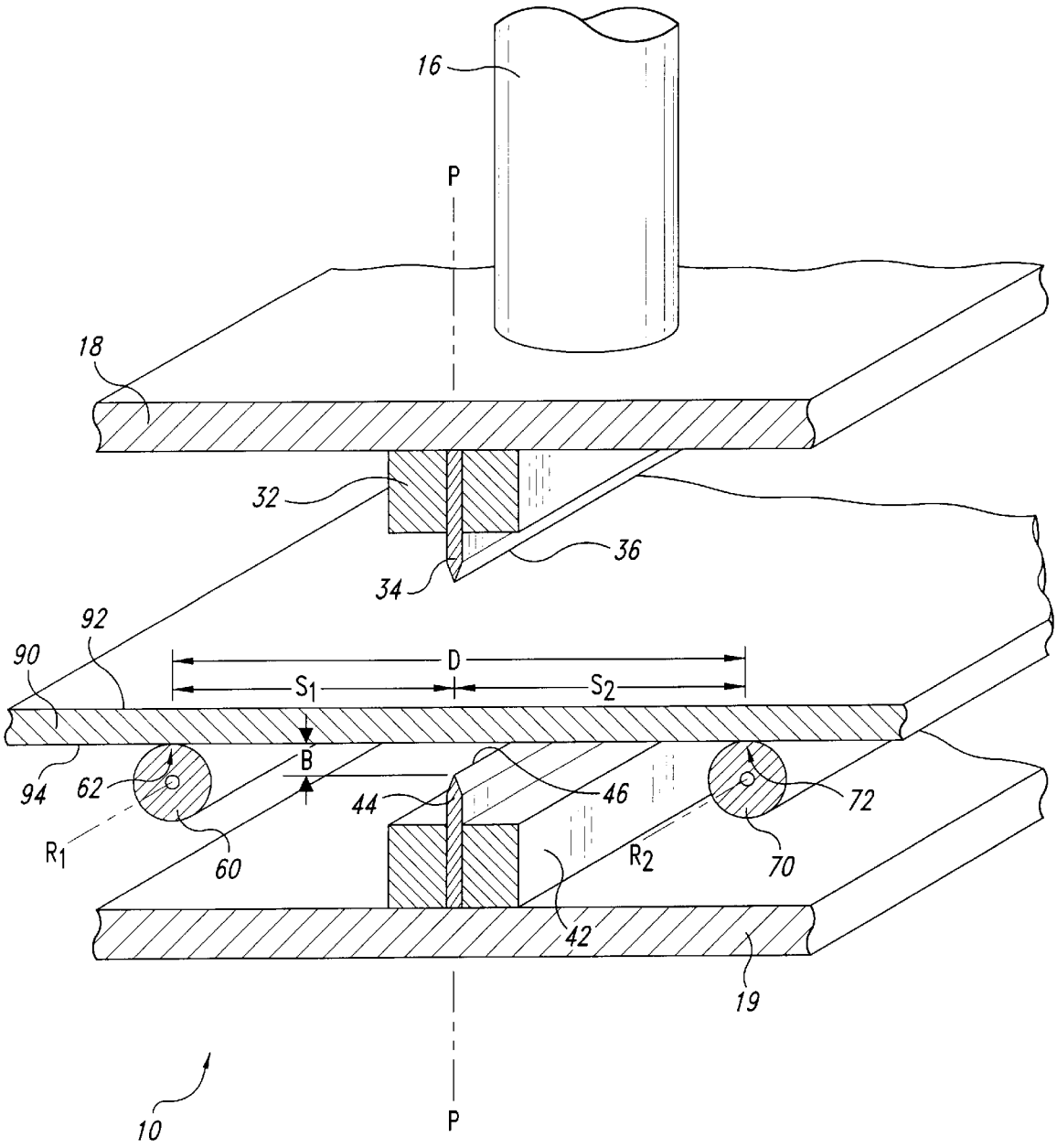
FIG. 2 is an isometric cross-sectional view partially illustrating the fiber-cement siding cutting tool of FIG. 1.

FIGS. 1 and 2 illustrate an FCS cutting machine 10 for cutting an FCS workpiece in accordance with one embodiment of the invention. In this embodiment, the cutting machine 10 includes a frame 12, a plurality of actuators 14 attached to the frame 12, and a driver 16 projecting from each actuator 14. The cutting machine 10 can also include a movable platform 18 attached to the drivers 16 and a fixed platform 19 attached to the frame 12. The moveable platform 18 can also be slidably coupled to the frame 12 using a groove and key mechanism or other types of slidable coupling devices. The actuators 14 can extend/retract the drivers 16 along drive axes (A) to drive the movable platform 18 along a stroke path P—P. For example, the actuators 14 can be pneumatic or hydraulic cylinders, and the drivers 16 can be rods or shafts. In an alternative embodiment, the actuators 14 can be rotational motors and the drivers 16 can be ball screws that threadedly engage the platform 18 such that rotation of the ball screws raises and lowers the movable platform 18. In still other embodiments, an actuator can be a hand-operated lever and a driver can be a linkage assembly, as shown in U.S. Pat. No. 5,570,678. The cutting machine 10 can accordingly be a freestanding apparatus or a table-top apparatus.

This embodiment of the cutting machine 10 also includes a first blade assembly 30 and a second blade assembly 40. The first blade assembly 30 can include a first blade holder 32 attached to the movable platform 18 and a first blade 34 attached to the first blade holder 32. The second blade assembly 40 can have a second blade holder 42 attached to the fixed platform 19 and a second blade 44 attached to the second blade holder 42. The first and second blades 34 and 44 are aligned with one another along a cutting plane defined by the stroke path P—P such that a first cutting edge 36 of the first blade 34 is juxtaposed to a second cutting edge 46 of the second blade 44. The first and second blades 34 and 44 can have a length sufficient to cut a long section (e.g., 4'–16') of an FCS workpiece in a single stroke of the actuators 14. The first and second blades 34 and 44 can also have a width between 0.0325–0.125 inch, and more preferably 0.0625 inch. As explained in greater detail below, the actuators 14 drive the first blade 34 toward the second cutting blade 44 to penetrate the first and second cutting edges 36 and 46 into first and second sides 92 and 94 of an FCS workpiece 90 (FIG. 2), respectively.

The cutting machine 10 further includes a workpiece support assembly having a first support member 60 on a first side of the stroke path P—P and a second support member 70 on a second side of the support path. In this particular embodiment, the first support member 60 is a first elongated roller that rotates about a first rotational axis $R_1$—$R_1$, and the second support member 70 is a second elongated roller that rotates about a second rotational axis $R_2$—$R_2$. The first and second support members 60 and 70 have first and second support regions 62 and 72, respectively, that contact the second side 94 of the workpiece 90. For example, when the first and second support members 60 and 70 are elongated rollers, the first and second support regions 62 and 72 are defined by the uppermost points of the first and second rollers. The first and second support regions 62 and 72 define a support plane that is spaced apart from the second edge 46 of the second blade 44 in a direction along the stroke path P—P toward the first cutting edge 36 of the first blade 34. The first and second support members 60 and 70 accordingly space the second side 94 of the workpiece 90 apart from the second cutting edge 46 by a bending distance B when the first blade 34 is separated from the first side 92 of the workpiece 90. The first and second support members 60 and 70 are also spaced apart from one another by a support distance D such that the first and second support regions 62 and 72 are spaced laterally apart from the stroke path P—P by side distances $S_1$ and $S_2$, respectively. The side distances $S_1$ and $S_2$ are preferably equal to approximately one-half of the support distance D.

The bending distance B and the side distances $S_1$ and $S_2$ are preferably selected so that the workpiece 90 can bend toward the second blade 44 without breaking or cracking the workpiece 90 prior to engaging the second side 94 with the second cutting edge 46. The bending distance B and the side distances $S_1$ and $S_2$ are a function of several factors, including the thickness, composition and shape of the particular workpiece. In applications for cutting ¼–5/16 inch thick FCS workpieces manufactured by James Hardie Building Products, Inc., the bending distance B is preferably from approximately 0.0625–0.125 inch, and the side distances $S_1$ and $S_2$ are preferably equal to one another in a range from approximately 2.625–2.875 inches. In other applications, the bending distance B can be from approximately 0.03125–0.75 inch, and the side distances $S_1$ and $S_2$ can be from 1–6 inches.

Figure 3A:
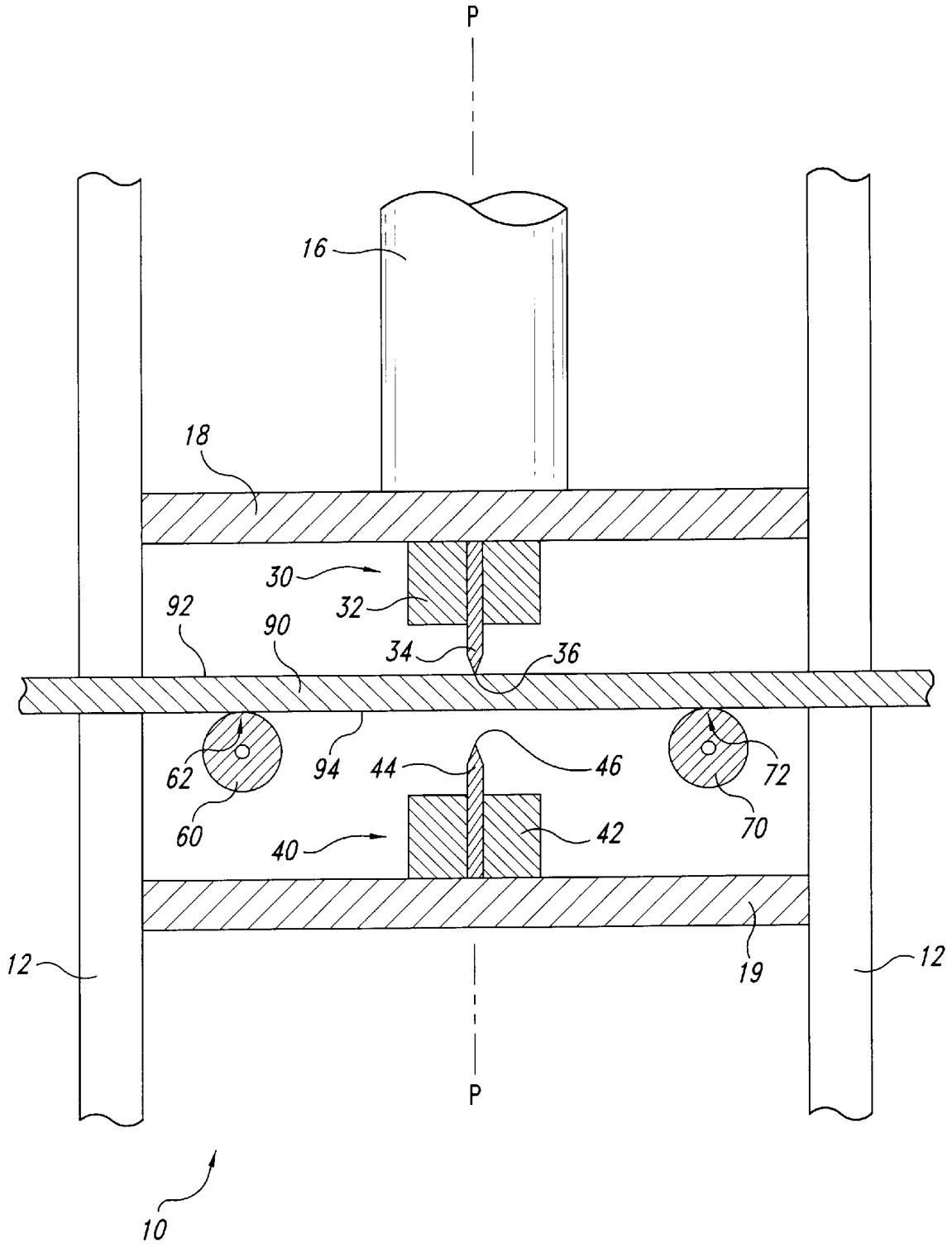
FIG. 3A is a partial cross-sectional view of the fiber-cement siding cutting tool of FIG. 1 illustrating one aspect of operating the cutting tool.
Figure 3B:
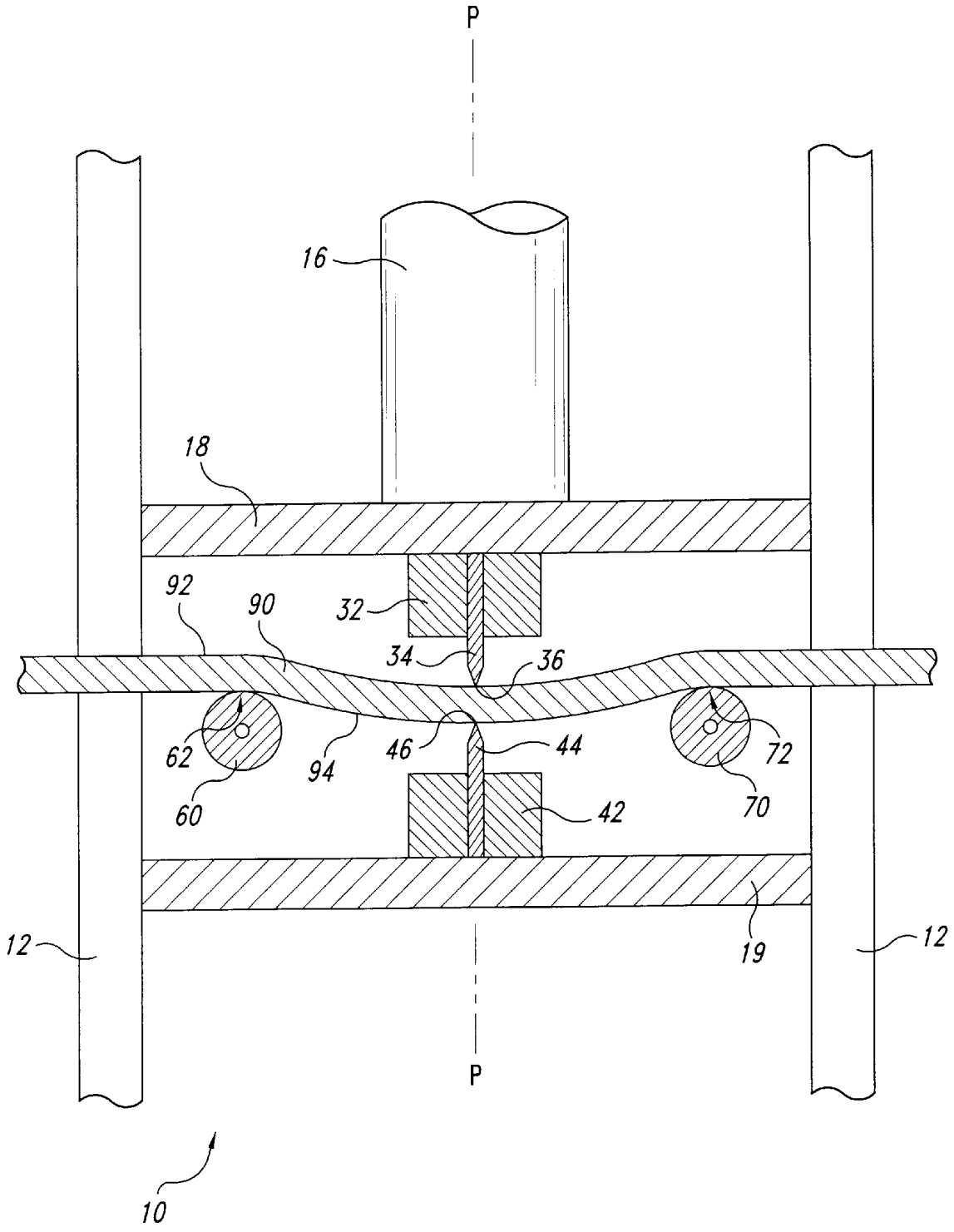
FIG. 3B is a partial cross-sectional view of the fiber-cement siding cutting tool of FIG. 1 illustrating another aspect of operating the cutting tool.

FIGS. 3A and 3B illustrate several aspects of operating the FCS cutting machine 10 of FIGS. 1 and 2. Referring to FIG. 3A, the diver 16 moves the movable platform 18 and the first blade assembly 30 downwardly along the stroke path P—P until the first edge 36 of the first blade 34 engages the first surface 92 of the workpiece 90. The driver 16 and the first blade assembly 30 are accordingly at a first stage of the cutting position in FIG. 3A. Referring to FIG. 3B, as the driver 16 continues to move the first blade 34 downwardly along the stroke path P—P, the first blade 34 bends the workpiece 90 between the first and second support members 60 and 70. More particularly, the curvature of the workpiece 90 between the first and second support members 60 and 70 imparts a compressive stress on the first surface 92 and a tensile stress on the second surface 94. The workpiece 90 accordingly bends until the second blade 44 contacts the second side 92 of the workpiece, and then the second edge 46 of the second blade 44 penetrates into the tensile second side 94 of the workpiece 90 to generate a crack that propagates along the cutting plane between the first and second blades 34 and 44.

The particular embodiment of the cutting tool 10 shown in FIGS. 1–3B provides several advantages compared to shears without the support members 60 and 70. By bending the FCS workpiece 90 to induce a tensile stress at the second surface 94 along the stroke path P—P, the first and second cutting blades 34 and 44 create and propagate a crack though the workpiece 90 along the cutting plane with less force compared to straight, unstressed workpieces. In one particular example, a 4' length of ¼-inch FCS panel was cut using only two pneumatic cylinders operating at 90 psi. This embodiment of the cutting tool 10, therefore, can cut long sections of FCS workpieces without heavy and expensive actuators. The first and second cutting blades 34 and 44 also have long operating lives because they penetrate into the workpiece 90 for only short distances. Moreover, the second side 94 of the workpiece 90 does not slide across the second edge 46 of the second blade 44 as the workpiece 90 is aligned with the first and second cutting blades 34 and 44. Therefore, this embodiment of the cutting tool 10 provides an efficient device for cutting long sections of FCS workpieces and enhances the operational life of the cutting blades.

Figure 4:
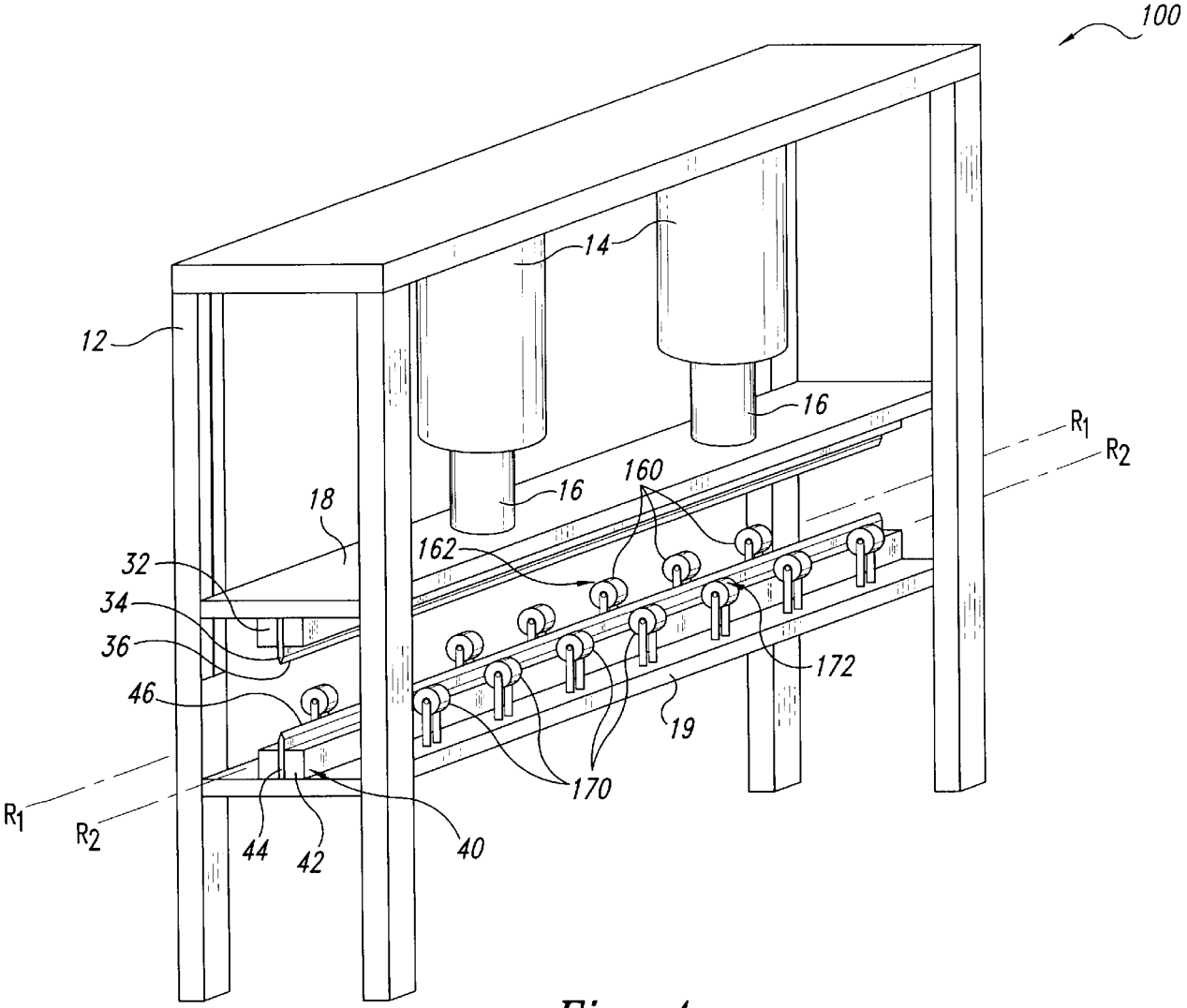
FIG. 4 is an isometric view of another fiber-cement siding cutting tool in accordance with another embodiment of the invention.

FIG. 4 illustrates an FCS cutting tool 100 in accordance with another embodiment of the invention. Several components of the FCS cutting tool 100 and the FCS cutting tool 10 are similar, and thus like reference numbers refer to like components in FIGS. 1–4. In this embodiment, the cutting tool 100 has at least one first support member 160 on the first side of the second blade 34 and at least one second support member 170 on the second side of the second blade 34. The first and second support members 160 and 170, for example, can be individual wheels that rotate about first and second rotational axes $R_1$—$R_1$ and $R_2$—$R_2$, respectively. In one aspect of this embodiment, a first plurality of wheels are aligned on the first rotational axis $R_1$—$R_1$ and a second plurality of wheels are aligned on the second rotational axis $R_2$—$R_2$. The wheels of the first and second support members 160 and 170 are preferably configured so that support regions 162 and 172 at the uppermost point of each wheel are in a common support plane positioned apart from the second cutting edge 36 of the second blade 34 by a bending distance. The embodiment of the cutting tool 100 illustrated in FIG. 4 is expected to operate in substantially the same manner as the cutting tool 10 illustrated in FIGS. 1–3B.

Figure 5:
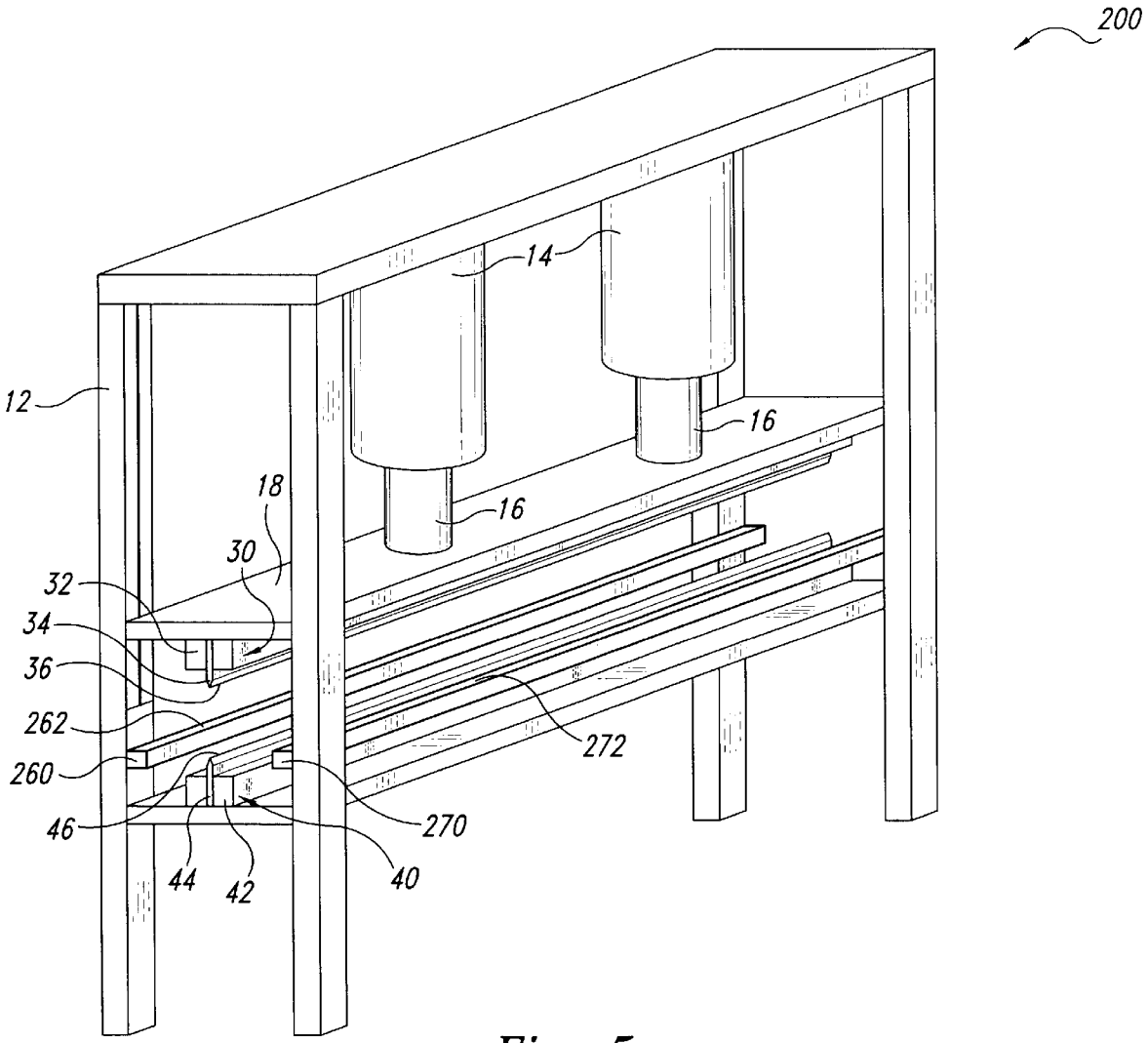
FIG. 5 is an isometric view of yet another fiber-cement siding cutting tool in accordance with yet another embodiment of the invention.

FIG. 5 illustrates an FCS cutting machine 200 in accordance with still another embodiment of the invention. Several components of the cutting tool 200 and the cutting tool 10 are also similar. In this embodiment, the cutting tool 200 has a first support member 260 defined by a first elongated bar attached to one side of the frame 12 and a second support member 270 defined by a second elongated bar attached the other side of the frame 12. The first support member 260 can have an upper surface defining a first support region 262 and the second support member 270 can have an upper surface defining a second support region 272. As described above with reference to FIG. 2, the first and second support regions 262 and 272 can also define a support plane positioned apart from the second edge 36 of the second blade 34 by a bending distance. Thus, this embodiment of the cutting machine 200 is also expected to operate in a manner similar to the embodiment of the cutting machine 10 described above with reference to FIGS. 1–3B.

Although specific embodiments of the invention have been described above for purposes of illustration and enablement, various modifications may be made to the embodiments and features described herein without deviating from the spirit and scope of the invention because the foregoing is not intended to be exhaustive or to limit the invention. For example, other types of support members may be used to support FCS workpieces above the second blade. Additionally, other embodiments may not have a first blade 34 that penetrates the workpiece 90, but rather a cutting tool can have an elongated driver that directly engages the workpiece to drive the second side 92 against the second blade 44. Aspects of the invention can also be applied to other materials, such as ceramics, cements or composites. Moreover, features of the foregoing embodiments can be combined with other features and aspects of cutting cement materials, such as forming non-linear cuts in fiber-cement siding as set forth in U.S. Pat. No. 5,722,386. Accordingly, the invention is not limited except as set forth in the appended claims.

What is claimed is:

1. A fiber-cement siding cutting machine, comprising:

an actuator including a driver that moves between a release position and a cutting position along a stroke path;

a pair of cutting blades including a first cutting blade having a first cutting edge and a second cutting blade having a second cutting edge, the first cutting blade being coupled to the driver to move along the stroke path between the release position and the cutting position, the second cutting blade being positioned along the stroke path, and the first cutting edge facing the second cutting edge along the stroke path, wherein the first cutting blade is superimposed over the second cutting blade; and a workpiece support assembly including a first support member on a first side of the stroke path and a second support member on a second side of the stroke path, the first and second support members being spaced apart from one another by a support distance, and the first and second support members each having a support region spaced apart from the second cutting edge toward the first cutting edge in the direction of the stroke path by a bending distance, wherein the first and second support members comprise first and second wheels rotatable about first and second rotational axes, respectively, the first and second rotational axes extending at least substantially parallel to a lengthwise dimension of the second cutting blade, wherein the support regions of the first and second wheels comprise an uppermost point of each of the first and second wheels spaced above the second cutting edge toward the first cutting edge in the direction of the stroke path by the bending distance, and wherein the first and second rotational axes are spaced laterally apart from the stroke path by a side distance of approximately one-half the support distance.

2. A fiber-cement siding cutting machine, comprising:

an actuator including a driver that moves between a release position and a cutting position along a stroke path;

a pair of cutting blades including a first cutting blade having a first cutting edge and a second cutting blade having a second cutting edge, the first cutting blade being coupled to the driver to move along the stroke path between the release position and the cutting position, the second cutting blade being positioned along the stroke path, and the first cutting edge facing the second cutting edge along the stroke path, wherein the first cutting blade is superimposed over the second cutting blade; and a workpiece support assembly including a first support member on a first side of the stroke path and a second support member on a second side of the stroke path, the first and second support members being spaced apart from one another by a support distance, and the first and second support members each having a support region spaced apart from the second cutting edge toward the first cutting edge in the direction of the stroke path by a bending distance, wherein the first and second support members comprise first and second wheels rotatable about first and second rotational axes, respectively, the first and second rotational axes extending at least substantially parallel to a lengthwise dimension of the second cutting blade, wherein the support regions of the first and second wheels comprise an uppermost point of each of the first and second wheels spaced above the second cutting edge toward the first cutting edge in the direction of the stroke path by a bending distance of approximately 0.03125 to 0.75 inches, and wherein the first and second rotational axes are spaced laterally apart from the stroke path by a side distance from approximately 1 to 6 inches.

3. A fiber-cement siding cutting machine, comprising:

an actuator including a driver that moves between a release position and a cutting position along a stroke path;

a pair of cutting blades including a first cutting blade having a first cutting edge and a second cutting blade having a second cutting edge, the first cutting blade being coupled to the driver to move along the stroke path between the release position and the cutting position, the second cutting blade being positioned along the stroke path, and the first cutting edge facing the second cutting edge along the stroke path, wherein the first cutting blade is superimposed over the second cutting blade; and a workpiece support assembly including a first support member on a first side of the stroke path and a second support member on a second side of the stroke path, the first and second support members being spaced apart from one another by a support distance, and the first and second support members each having a support region spaced apart from the second cutting edge toward the first cutting edge in the direction of the stroke path by a bending distance, wherein the first and second support members comprise first and second wheels rotatable about first and second rotational axes, respectively, the first and second rotational axes extending at least substantially parallel to a lengthwise dimension of the second cutting blade, wherein the support regions of the first and second wheels comprise an uppermost point of each of the first and second wheels spaced above the second cutting edge toward the first cutting edge in the direction of the stroke path by a bending distance of approximately 0.0625 to 0.125 inches, and wherein the first and second rotational axes are spaced laterally apart from the stroke path by a side distance from approximately 2.5 to 3 inches.

4. A fiber-cement siding cutting machine, comprising:

an actuator including a driver that moves between a release position and a cutting position along a stroke path;

a pair of cutting blades including a first cutting blade having a first cutting edge and a second cutting blade having a second cutting edge, the first cutting blade being coupled to the driver to move along the stroke path between the release position and the cutting position, the second cutting blade being positioned along the stroke path, and the first cutting edge facing the second cutting edge along the stroke path, wherein the first cutting blade is superimposed over the second cutting blade; and a workpiece support assembly including a first support member on a first side of the stroke path and a second support member on a second side of the stroke path, the first and second support members being spaced apart from one another by a support distance, and the first and second support members each having a support region spaced apart from the second cutting edge toward the first cutting edge in the direction of the stroke path by a bending distance, wherein the first and second support members comprise first and second elongated bars, respectively, the first and second bars extending at least substantially parallel to a lengthwise dimension of the second cutting blade, the first and second bars having first and second upper surfaces, respectively, spaced above the second cutting edge toward the first cutting edge in the direction of the stroke path by the bending distance, and wherein the first and second upper surfaces are each spaced laterally apart from the stroke path by a side distance of approximately one-half of the support distance.

5. A fiber-cement siding cutting machine, comprising:

an actuator including a driver that moves between a release position and a cutting position along a stroke path;

a pair of cutting blades including a first cutting blade having a first cutting edge and a second cutting blade having a second cutting edge, the first cutting blade being coupled to the driver to move along the stroke path between the release position and the cutting position, the second cutting blade being positioned along the stroke path, and the first cutting edge facing the second cutting edge along the stroke path, wherein the first cutting blade is superimposed over the second cutting blade; and a workpiece support assembly including a first support member on a first side of the stroke path and a second support member on a second side of the stroke path, the first and second support members being spaced apart from one another by a support distance, and the first and second support members each having a support region spaced apart from the second cutting edge toward the first cutting edge in the direction of the stroke path by a bending distance, wherein the first and second support members comprise first and second elongated bars, respectively, the first and second bars extending at least substantially parallel to a lengthwise dimension of the second cutting blade, the first and second bars having first and second upper surfaces, respectively, spaced above the second cutting edge toward the first cutting edge in the direction of the stroke path by a bending distance of approximately 0.03125 to 0.75 inches, and wherein the first and second upper surfaces are each spaced laterally apart from the stroke path by a side distance of approximately 1 to 6 inches.

6. A fiber-cement siding cutting machine, comprising:

an actuator including a driver that moves between a release position and a cutting position along a stroke path;

a pair of cutting blades including a first cutting blade having a first cutting edge and a second cutting blade having a second cutting edge, the first cutting blade being coupled to the driver to move along the stroke path between the release position and the cutting position, the second cutting blade being positioned along the stroke path, and the first cutting edge facing the second cutting edge along the stroke path, wherein the first cutting blade is superimposed over the second cutting blade; and a workpiece support assembly including a first support member on a first side of the stroke path and a second support member on a second side of the stroke path, the first and second support members being spaced apart from one another by a support distance, and the first and second support members each having a support region spaced apart from the second cutting edge toward the first cutting edge in the direction of the stroke path by a bending distance, wherein the first and second support members comprise first and second elongated bars, respectively, the first and second bars extending at least substantially parallel to a lengthwise dimension of the second cutting blade, the first and second bars having first and second upper surfaces, respectively, spaced above the second cutting edge toward the first cutting edge in the direction of the stroke path by a bending distance of approximately 0.0625 to 0.125 inches, and the first and second upper surfaces are each spaced laterally apart from the stroke path by a side distance of approximately 2.5 to 3 inches.

7. A fiber-cement siding cutting machine, comprising:

an actuator including a driver that moves between a release position and a cutting position along a stroke path;

a pair of cutting blades including a first cutting blade having a first cutting edge and a second cutting blade having a second cutting edge, the first cutting blade being coupled to the driver to move along the stroke path between the release position and the cutting position, the second cutting blade being positioned along the stroke path, and the first cutting edge facing the second cutting edge along the stroke path, wherein the first cutting blade comprises a first serrated blade having a width of approximately 0.0625 to 0.125 inches and a length of approximately 2 to 16 feet in a lengthwise direction, and the second cutting blade comprises a second serrated blade having a width of approximately 0.0625 to 0.125 inches and a length of approximately 2 to 16 feet in the lengthwise direction, the first cutting blade being superimposed over the second cutting blade; and a workpiece support assembly including a first support member on a first side of the stroke path and a second support member on a second side of the stroke path, the first and second support members being spaced apart from one another by a support distance, and the first and second support members each having a support region spaced apart from the second cutting edge toward the first cutting edge in the direction of the stroke path by a bending distance, wherein the first and second support members comprise first and second elongated rollers rotatable about first and second rotational axes, respectively, the first and second rotational axes extending at least substantially parallel to the lengthwise dimension of the second cutting blade, wherein the support regions of the first and second rollers comprise an uppermost point of each of the first and second rollers spaced above the first cutting edge toward the second cutting edge in the direction of the stroke path by the bending distance, and wherein the rotational axes of the first and second rollers are spaced laterally apart from the stroke path by a side distance.

8. The fiber-cement siding cutting machine of claim 7 wherein the bending distance is from approximately 0.03125 to 0.75 inches and the side distance is from approximately 1 to 6 inches.

9. The fiber-cement siding cutting machine of claim 7 wherein the bending distance is from approximately 0.0625 to 0.125 inches and the side distance is from approximately 2.5 to 3 inches.

10. A method of cutting a fiber-cement workpieces, comprising:

imparting a tensile stress on one side of the workpiece before forming an indentation on the one side; and propagating a crack along a cutting plane through the workpiece from the one side to another side.

11. The method of claim 10 wherein:

imparting the tensile stress on the one side of the workpiece comprises bending the workpiece at the cutting plane; and propagating the crack comprises forming an indentation on the one side of the workpiece as the workpiece is bent to exert the tensile stress to the one side.

12. The method of claim 10 wherein:

imparting the tensile stress on the one side of the workpiece comprises bending the workpiece at the cutting plane by driving a first cutting blade against the other side of the workpiece and supporting the one side of the workpiece on either side of the first cutting blade using first and second support members; and propagating the crack comprises forming an indentation on the one side of the workpiece by engaging the one side of the workpiece with a second cutting blade after bending the workpiece a desired bending distance.

13. The method of claim 10 wherein:

imparting the tensile stress on the one side of the workpiece comprises bending the workpiece at the cutting plane by driving a first cutting blade against the other side of the workpiece along a stroke path and supporting the one side of the workpiece on either side of the first cutting blade using first and second support members; and propagating the crack comprises penetrating the one side of the workpiece with a second blade under the one side of the workpiece and spaced apart from the first and second support members away from the first blade in the direction of the stroke path by a bending distance.

14. The method of claim 10 wherein:

imparting the tensile stress on the one side of the workpiece comprises bending the workpiece at the cutting plane by driving a first cutting blade against the other side of the workpiece along a stroke path and supporting the one side of the workpiece on either side of the first cutting blade using first and second support members; and propagating the crack comprises engaging the one side of the workpiece with a second blade by flexing the workpiece through a bending distance and into contact with the second blade.

* * * * *

UNITED STATES PATENT AND TRADEMARK OFFICE

CERTIFICATE OF CORRECTION

PATENT NO. : 6,102,026
DATED : August 15, 2000
INVENTOR(S) : Fladgard et al.

It is certified that error appears in the above-identified patent and that said Letters Patent is hereby corrected as shown below:

Title page,
Item [73], Assignee should be -- Pacific International Tool & Shear, Ltd., Kingston, Wash. --;

Column 1,
Line 33, "moreover" should be -- Moreover --;
Line 60, "cuffing" should be -- cutting --;

Signed and Sealed this

Twenty-fourth Day of December, 2002

JAMES E. ROGAN
*Director of the United States Patent and Trademark Office*